US005233970A

United States Patent [19]

Harris

[11] Patent Number: 5,233,970

[45] Date of Patent: Aug. 10, 1993

[54] SEMI-INSTANTANEOUS WATER HEATER WITH HELICAL HEAT EXCHANGER

[75] Inventor: James A. Harris, Wichita, Kans.

[73] Assignee: Harmony Thermal Company, Inc., Greeley, Colo.

[21] Appl. No.: 907,622

[22] Filed: Jul. 2, 1992

[51] Int. Cl.[5] ..... F24H 1/00

[52] U.S. Cl. ..... 126/351; 126/350 R; 126/350 D

[58] Field of Search ..... 126/350 R, 351, 350 D; 165/41, 38, 169; 236/25 R, 20 R

[56] References Cited

U.S. PATENT DOCUMENTS

| | | | |
|---|---|---|---|
| 1,132,757 | 3/1915 | Ashton . | |
| 1,465,109 | 8/1923 | Boggs | 126/350 R |
| 2,189,490 | 2/1940 | Hart | 126/350 R |
| 2,704,657 | 7/1955 | Taylor . | |
| 3,739,842 | 6/1973 | Whalen | 165/164 |
| 4,061,184 | 1/1977 | Radcliffe | 165/38 |
| 4,278,069 | 7/1981 | Clark, Jr. | 126/366 |
| 4,805,590 | 2/1989 | Farina et al. | 126/101 |
| 4,823,770 | 4/1987 | Loeffler | 126/362 |
| 4,880,157 | 11/1989 | Boot et al. | 236/25 |
| 4,895,203 | 1/1990 | McLaren | 165/41 |

FOREIGN PATENT DOCUMENTS

| | | | |
|---|---|---|---|
| 134156 | 5/1989 | Japan | 126/350 D |

*Primary Examiner*—Larry Jones

[57] ABSTRACT

A semi-instantaneous water heater is disclosed. The water heater generates domestic hot water by transferring heat from the circulating fluid of a modulating boiler. It is particularly suited for use in a combination system, which provides both space and water heating. The semi-instantaneous design incorporates a small cylindrical tank containing stored hot water and an immersed heat exchanger. The heat exchanger is a helical coil disposed in the annular space between two metal sheets that have been rolled into cylinders. The coil conveys heated fluid from the boiler. Heat from the coil is transferred to the water, which is admitted to the tank via the helical passageway formed by the two sheets and the inter-coil space of the helix. The heat exchanger effectively transfers heat by forced convection at a high rate when required by a high flowrate of water. Its disposition in the tank also permits good heat transfer by free convection to quiescent water in the tank when this heating mode is required. The stored volume of hot water provides thermal capacitance to meet brief draws of hot water without short period on/off cycling of the boiler. It also aids in maintaining temperature stability when the hot water flowrate is turned up or down. The small size of the tank allows for effective thermal insulation, thereby minimizing heat loss.

4 Claims, 2 Drawing Sheets

SEMI-INSTANTANEOUS WATER HEATER WITH HELICAL HEAT EXCHANGER

BACKGROUND OF THE INVENTION

1. Field of the Invention

This invention relates to domestic water heaters used with circulating boilers, particularly in a combination water and space heating system.

2. Discussion of the Background

It is possible to utilize a circulating boiler in a system which provides both space heat and domestic hot water. Such systems are often used in large commercial, industrial, and institutional buildings, and less frequently in residential and light commercial buildings. The present invention is intended primarily for the latter application.

A combination system based on a circulating boiler can be configured in several ways. These different approaches fall into two broad categories: open loop systems and closed loop systems. In an open loop system, potable water is utilized as the circulating boiler fluid, and hot water taps are branched directly from the boiler loop. It is characteristic of such a system that the boiler circulates a constantly changing supply of water as hot water draws are made from the loop and cold supply water replaces it. It is also characteristic of such a system that the water circulated for the purpose of space heating must have the same temperature as that of the potable hot water.

In the closed loop system, the boiler loop is separated from the domestic hot water system, and an unchanging supply of fluid is circulated in the boiler loop. In a closed loop combination system, domestic hot water is generated by a heat exchanger whose function it is to maintain physical separation between the circulating boiler fluid and the domestic water supply. A closed loop system is somewhat more complex than an open loop system, but it offers three advantages:

1. Mineral buildup in the boiler loop is eliminated.
2. The boiler loop can operate at a higher temperature.
3. Fluid other than water, such as steam, brine, or antifreeze solution, can be used in the boiler loop.

The advantage of operating the boiler loop at a higher temperature (say 200 F.) is that if radiators or convectors are used for space heat, less heat transfer area is required to move a given amount of heat than if the boiler loop is limited to normal domestic hot water temperature (about 140 F.).

There have been several approaches to heat exchanger design for generating domestic hot water in closed loop combination systems. These approaches can be broadly categorized as follows:

1. Storage tank water heaters
2. Instantaneous water heaters
3. Semi-instantaneous water heaters.

In the first approach, a heat exchanger is immersed in a relatively large tank. This heat exchanger is usually a tube coil; the tube may be either finned or unfinned. A further characteristic of such a system is that the tankside fluid is relatively quiescent as far as the heat transfer regime is concerned. In the storage tank heater, no effort is made to promote fluid velocity over the heat exchange surface on the tank side; therefore free convection is the predominant tankside heat transfer mechanism. The storage tank heater is therefore characterized by a modest rate of heat transfer relative to the volume of water stored, and hot water demand is met largely by stored capacitance. The best way to plumb such a system is to circulate boiler fluid in the tube coil and store domestic hot water in the tank. One advantage of the storage tank water heater is inherent temperature stability in the hot water supply due to the large thermal capacitance of the stored hot water. Another advantage is that a single-input (nonmodulating) boiler may be used. A third advantage is that a large flowrate may be tapped, at least until the tank is drained of hot water and the boiler cannot keep up with the demand. The disadvantage is that a large tank must be used, with the associated cost, bulk, and thermal loss. Sometimes, the boiler fluid is circulated through the tank and the domestic water is plumbed through the immersed tube coil. Unfortunately, this arrangement retains the disadvantages of the storage tank while reaping little of the benefit. The thermal capacitance is not put to good use, since at high hot water draw, heat will not be transferred at a rate sufficient to maintain hot water temperature unless the coil area is made very large.

The instantaneous water heater is a heat exchanger without any appreciable volume, in which heat is transferred from the boiler fluid flowing through on one side to the domestic water flowing through on the other side. Typically, high fluid velocity is maintained on both sides of the heat exchanger, augmenting the heat transfer coefficient and making possible a compact design relative to the heat transfer rate capacity of the unit. Typical of these compact heat exchangers are tube-in-tube and shell-and-tube designs. Operationally, the system must have a means to sense hot water draw (a flow switch). The boiler circulation pump and ignition system are energized when water flow is sensed. Also, an automatically modulating boiler is mandatory in this system, since there is little thermal capacitance. The heat input to the boiler must closely follow the heating rate required for the hot water draw rate. Temperature instability due to rapid changes in hot water flowrate is inevitable in this system, and the best that can be hoped for in the design of the control system is to keep such instability to a reasonable level. The advantage of the instantaneous water heater is that no hot water is stored, so that there is no corresponding thermal loss. The disadvantages are system complexity and control difficulty. Another disadvantage is that the boiler is ill-suited to respond to demand spikes, in which a hot water tap is opened for a short period and then closed. With the instantaneous water heater, a series of demand spikes causes the boiler to ignite and shut down in rapidfire sequence, which is an undesirable operational mode. A boiler operates best at steady-state or quasi steady-state; during startup and shutdown, gas is wasted. Therefore, it is advantageous to avoid excessive boiler on/off cycling.

The semi-instantaneous water heater is an approach that is in between the preceding two. It realizes in some measure the advantages of each while minimizing the disadvantages. In this approach, a compact forced convection heat exchanger is used with a small storage tank of hot water which provides some thermal capacitance. The tank-heat exchanger system is designed so that heat can also be transferred from circulating boiler fluid to quiescent water in the tank when there is no domestic water flow through the heat exchanger. Therefore, the heat exchanger can operate in two modes: in the flow (forced convection) mode, heat is transferred at a high rate, thereby providing the capability for delivering an endless flow of hot water; in the recharge (free convection) mode, heat is transferred at a lower rate to quiescent water in the tank, thereby maintaining a small volume of stored hot water. There are several advantages related to maintaining this stored volume of hot water. A modulating boiler must be used in this system as it is with the instantaneous water heater, but the thermal capacitance dampens out the temperature instabilities associated with the instantaneous water heater. It also permits a looser link between the boiler heating rate and the heating rate associated with the rate of hot water draw, thereby making controller design easier. In fact, with the semi-instantaneous water heater, the flow switch can be eliminated, and hot water temperature in the heater tank can be used as the feedback control variable. The thermal capacitance also eases considerably the boiler cycling problem that can arise from demand spikes.

The present invention is a semi-instantaneous water heater of novel design. When used with a modulating boiler, particularly in a combination space and water heating system, it provides the advantages summarized above. These and other advantages of the invention will be discussed in the following section.

SUMMARY OF THE INVENTION

The semi-instantaneous water heater disclosed herein is a counterflow heat exchanger immersed in a small water tank. The conduit for circulating boiler fluid is a copper tube which is wound into a helical coil. The coil is enclosed in an annular space formed between two copper sheets which have been rolled into cylinders. The copper tube is in contact with the inner and outer sheets, and the spacing between coils is approximately equal to the tube diameter. Therefore, a second helical conduit is formed in the annular space between the tube coils, and the domestic water to be heated is introduced into this conduit. It flows in a counterflow direction to the boiler fluid flowing in the coil, and discharges from the heat exchanger directly into the tank. The tank is cylindrical, and has a length and diameter only slightly greater than the corresponding length and diameter of the helical coil assembly. As an example of the sizing involved, a semi-instantaneous water heater of this design capable of transferring 80,000 btu/hour in the flow mode between the water and boiler fluid flowing through the unit can have a helical coil of half-inch diameter copper tube, with 3.5 inch inside coil diameter, 4.5 inch outside coil diameter, and 12 inch coil length. It can then be immersed in a cylindrical tank having 6 inch inside diameter and 14 inch length. The tank volume is about 1.7 gallons. In terms of hot water flowrate, the heat exchanger can deliver two gallons per minute of hot water heated from 60 F. to 140 F. The boiler fluid, pumped at two gallons per minute, enters the coil at 200 F. and exits at 120 F. (assuming water to be the boiler fluid in this case).

A temperature sensor is immersed in the tank, at a location near the water outlet of the heat exchanger. Control is typically based on a hysteresis-deadband approach. With a deadband of +/−10 F., operation would occur as follows. When the temperature sensor indicates a temperature of 10 F. below the setpoint hot water temperature (typically 140 F.), the circulation pump and ignition system of the boiler are energized. The controller modulates the input to the boiler so as to bring in and maintain the temperature sensor at the setpoint. Normally, a proportional-integral-differential (PID) control algorithm will be implemented for this phase of control. It will usually be desirable to locate a temperature sensor on the boiler discharge as well, so that the controller can act to prevent the boiler discharge temperature from exceeding say 210 F. Operationally, the boiler will continue heating until the tank temperature reaches 150 F., at which time the controller will shut off the boiler. The deadband in this example is +/−10 F.; it could be set to be greater or less, depending on the application.

There is no need for a flow sensor in the system; control is effected solely on the basis of the tank temperature, as it is in the storage tank approach. This means that the boiler can come on to heat the tank water even if there is no water flow (the recharge mode). For instance, during an extended period during which there are no hot water draws (e.g. overnight), heat loss from the tank could bring the water temperature down below 130 F., triggering the controller to deliver boiler heating. In this case, another advantage of the present invention comes to the fore: the heat exchanger, even though very compact, can deliver heat to the quiescent water in the tank at a rate at least equal to the lowest heating rate the modulating boiler is capable of delivering. Therefore, the boiler can bring the tank temperature back up to 150 F. (with the burner at a low input) without overheating (i.e. without exceeding the 210 F. limit on the boiler outlet). Typically, a modulating boiler capable of a four-to-one turndown ratio will be required. In other words, the heat exchanger as described above can transfer about 20,000 btu/hour from circulating boiler fluid to quiescent water in the tank, when the unit is in the recharge mode. This is because heat will be transferred from the tube coil, through the inner and outer annular sheets, and to the water in the tank. In order to maximize this free convection regime, it is desirable to orient the tank vertically. For the example system operating in the free convection recharge mode, boiler fluid is still pumped at two gallons per minute through the coil, entering at about 200 F. and leaving at about 180 F.

The two extremes of operation have been described for the semi-instantaneous water heater. At intermediate hot water draws, the controller modulates the input to the boiler in the PID mode to maintain the setpoint water temperature.

There is a disadvantage associated with standby thermal loss from a tank of hot water. This disadvantage can be fairly pronounced in a storage tank system. For the semi-instantaneous heater, this problem is minimized because of the small size of the tank. A small tank is easier to insulate simply because it is small; there is less external surface from which heat is lost. Also, more effective (but expensive) insulation materials and methods can be utilized, since there is less tank surface to insulate. In comparing this system with a direct-fired storage tank heater (the type most common in the U.S.), thermal losses will be dramatically lower. One large factor, in addition to small size, is the fact that there is no flue loss in this system, whereas standby loss through the flue is very significant in the direct-fired storage tank. The thermal loss issue must also be weighted against the immediate hot water issue. With an instantaneous system, whether it is the indirect combination system described herein, or a direct-fired tankless water heater, there is a significant time lag associated with a cold start. If a hot water tap is opened after an extended period of inactivity, the burner must heat a significant mass of copper and water in the cold system before hot water begins to flow from the tap. Therefore, a significant amount of water can be wasted waiting for hot water. If, however, there is a reservoir of hot water ready to be tapped at all times, the cold-start time lag is substantially eliminated (other than the lag associated with the pipe run from the heater to the tap).

In addition to the benefit of immediate hot water availability, the stored thermal capacitance of the tank produces three other benefits. The first is enhanced temperature stability, as has been already mentioned. When there is a sudden change in hot water flowrate, the thermal capacitance of the tank water dampens the temperature instability associated with controller adjustment to the boiler heat input to bring the water temperature back to the setpoint. Second, the thermal capacitance eliminates short period on/off cycling of the boiler. Even in the recharge mode, when the boiler is delivering its minimum heat rate, a 20 F. deadband requires that it stay on for about one minute. This is the minimum on-time that can occur. Short-duration demand spikes are met largely by stored capacitance, thereby integrating heating requirements over time so that the boiler can be operated in the steady-state or quasi steady-state mode for which it is intended. Third, the thermal capacitance allows a very low flow of hot water to be sustained over a period of time. The boiler can cycle on and off to deliver the long-term average heating rate necessary to sustain the low flow. This solves another problem that occurs with both direct-fired tankless water heaters and the instantaneous water heater described previously. That is the problem of minimum flow. To actuate the burner with an instantaneous water heater, a water flow commensurate with the minimum heating rate of the boiler must be drawn. Thus, low flows of hot water cannot be drawn from such a system because the boiler cannot deliver heat at so low a rate. The thermal capacitance of the semi-instantaneous heater solves this problem.

In terms of prior art, it is notable that a design similar to the present invention has not been used heretofore. Where related approaches have been used in the past is in water coolers for drinking fountains. See for example U.S. Pat. Nos. Taylor (2,704,657), Whalen (3,739,842) and Radcliffe (4,061,184). These patents disclose a refrigerant tube which is helically wrapped around the sidewall of a cylindrical tank, with a water tube also helically wrapped in close proximity to the refrigerant tube. Water is introduced into the tank through the helical water tube, and is thereby precooled before entering the tank. However, none of these patents discloses a fully immersed heat exchanger that is intended to effectively transfer heat to quiescent water in the tank as well as water flowing through the exchanger.

There have been many heat exchangers built in which a tube is wrapped helically in an annular space and the second fluid passageway is formed as herein described. See for example U.S. Pat. No. McLaren (4,895,203). However, this patent does not disclose an integral storage tank.

An example of prior art in the field of semi-instantaneous water heaters in U.S. Pat. No. Clark (4,278,069). This patent discloses a semi-instantaneous water heater intended for large commercial/institutional applications. It incorporates a different heat exchanger design, and an external force recirculation loop. This patent demonstrates the concept of a semi-instantaneous water heater, but implements it in a much different manner from the present invention.

In summary, the semi-instantaneous water heater disclosed herein provides the advantages of thermal capacitance, as detailed above. At the same time, it provides the advantages of a forced convection heat exchanger, namely compact size and the ability to transfer heat at high rate to flowing water, thereby permitting hot water draws of high flowrate and indefinite duration. It uses common materials and is easy and inexpensive to manufacture. Its compact size permits good thermal insulation with a modest amount of insulation material. It is easy to scale the design up or down, depending on the heating rate capacity and/or thermal capacitance that is desired. Combining this invention with a modulating boiler and modern electronic control results in a system which implements a most advantageous approach for combined space and water heating, from the standpoint of efficiency, simplicity, compact size, and operational characteristics. If the boiler and water heater are integrated into a single package, this package can provide all the space and water heating needs of a typical residence, and yet fit into a small closet.

DETAILED DESCRIPTION OF THE PREFERRED EMBODIMENT

Figure 1:
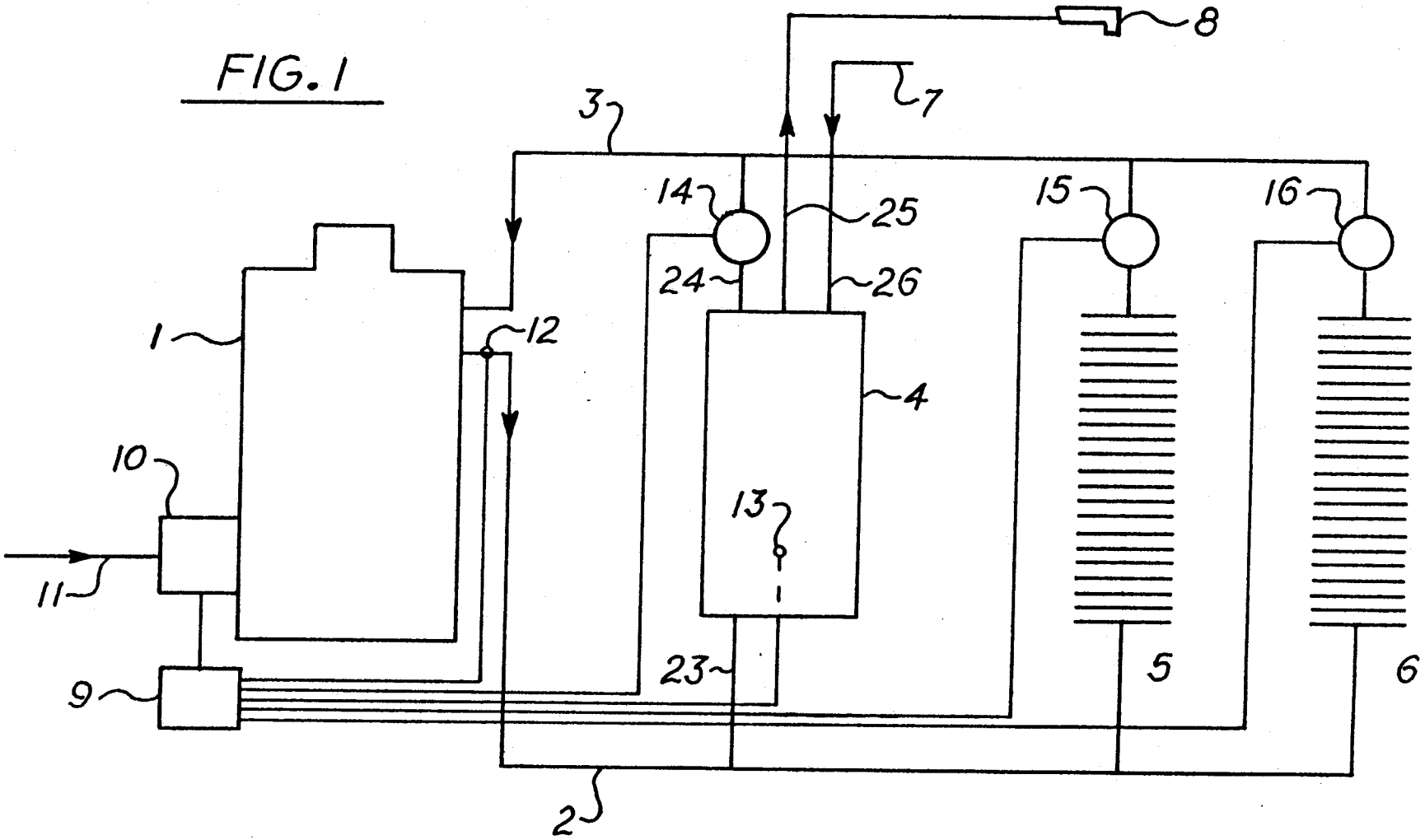
FIG. 1 shows a schematic diagram of a combination heating system comprising a modulating boiler, a semi-instantaneous water heater, and two space heating zones.

FIG. 1 is a schematic diagram showing how a semi-instantaneous water heater could be incorporated into a combination water and space heating system. A gas-fired boiler 1, designed for variable input, heats circulating water entering from return line 3, and discharges to supply line 2. Between the supply and return lines are plumbed in parallel semi-instantaneous water heater 4 and two space heating zones 5 and 6. Flow through each of these parallel legs is provided by corresponding pumps 14, 15, and 16.

Domestic water enters the semi-instantaneous heater from supply line 7, and hot water is withdrawn through hot water discharge line 25 for use at tap 8. The temperature of the water in the tank is monitored by sensor 13, which is connected to automatic electronic controller 9. The controller in turn is connected to burner control unit 10. Gas supply line 11 conveys gas to the burner control unit, which performs the automatic gas shutoff, modulation, and ignition functions for the boiler. Temperature sensor 12, located to monitor the temperature of the boiler fluid at the discharge, is also connected to the electronic controller so that the controller can act to prevent boiler overheating.

In operation, when temperature sensor 13 indicates a tank temperature less than the lower temperature of the deadband, the controller acts to energize the burner control unit, and the burner is lit. Simultaneously, the controller acts to start pump 14. The controller then acts on the burner control unit to modulate the flow of gas to the burner in order to bring temperature sensor 13 to the setpoint temperature in a rapid fashion, and then maintain it at the setpoint temperature. Further, the controller monitors the boiler discharge temperature at 12 continuously, and acts to decrease the gas input to the burner if it senses an overheat situation.

When the controller senses the tank temperature at 13 to go above the upper temperature of the deadband (the burner will be at its minimum input at this point in the operational cycle), it acts to shut off gas flow to the burner and shut off pump 14. The controller uses a proportional-integral-differential (PID) control algorithm during the active phase of control. The deadband is a few degrees in width above and below the setpoint hot water temperature.

If the water supply is preheated, as in a solar water heating system, the semi-instantaneous heater will function as a booster unit. Since the controller acts only on the temperature at 13, the inlet water temperature is irrelevant from an operational and control standpoint.

During the heating season, a call for space heat in zone 5 and/or zone 6 triggers the controller to fire the boiler, turn on pump 15 and/or 16, and modulate the input to maintain the discharge temperature 12 at a desired value, typically 200° F. A call for hot water, as evidenced by a decrease in temperature 13, triggers the controller to start pump 14 and modulate the boiler to bring temperature 13 to the hot water setpoint, shutting off pumps 15 and 16 if necessary. In this manner, the system can be operated in a "hot water override" mode, where space heating is given secondary priority.

Figure 2:
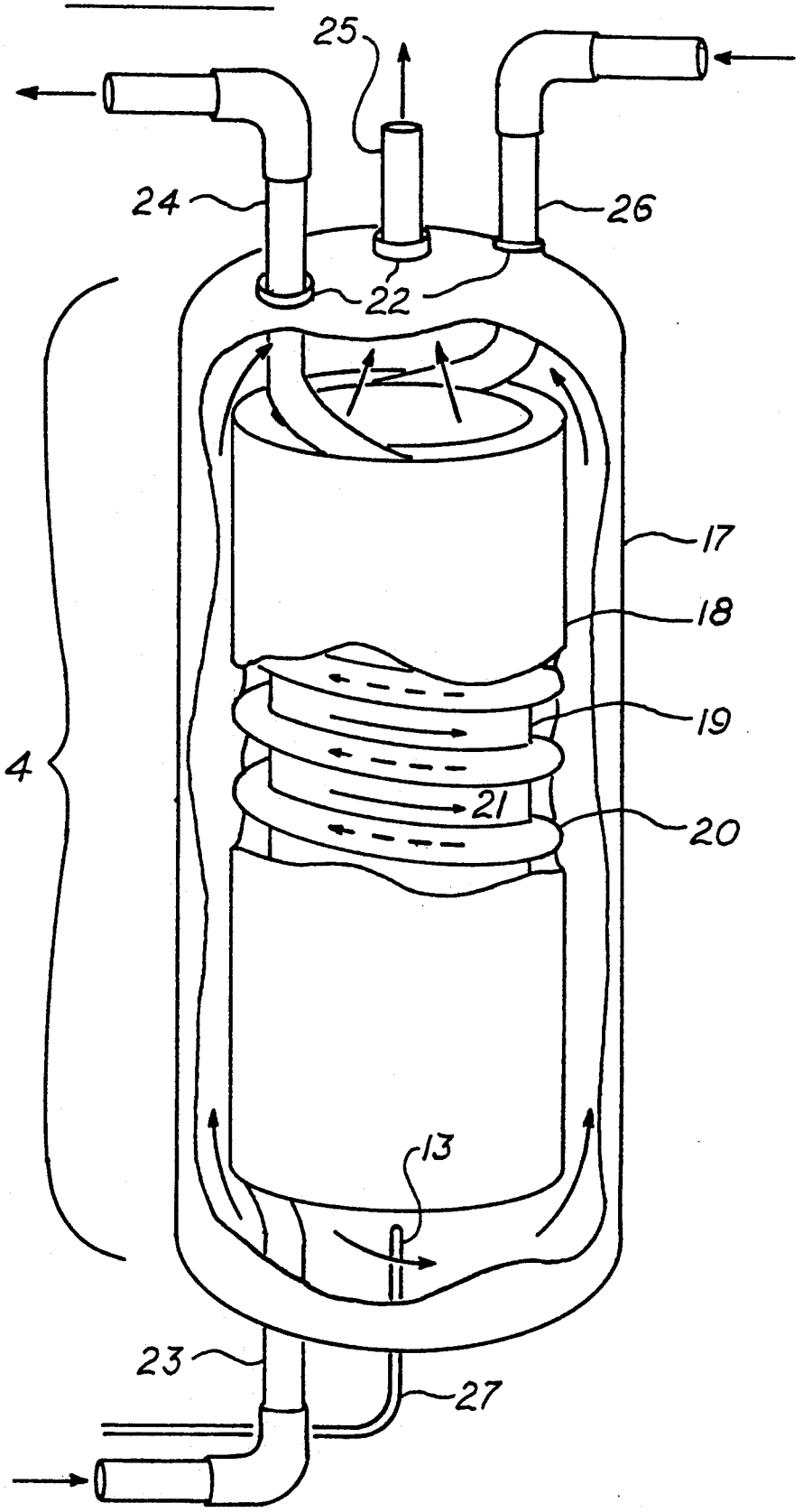
FIG. 2 shows a cutaway view of the semi-instantaneous water heater.

FIG. 2 is a dual cutaway view of the semi-instantaneous water heater. A tank 17 has cylindrical shape, with fittings 22 which provide for a pressure seal where the copper water tubes 23–26 pass through the tank wall. A similar fitting is located where temperature probe 27 passes through the tank wall. Temperature sensor 13 is located inside the end of probe 27.

Inside the tank is the heat exchanger, formed by a helical tube coil 20, wrapped around an inner sheet metal cylinder 19, and enclosed by an outer sheet metal cylinder 18. Typically, coil 20 and cylinders 18 and 19 are made of copper. The ends of coil 20 are joined to boiler supply line connection 23 and boiler return line connection 24. Alternatively, if tube bending radii permit, one continuous tube may be used to form coil 20 and supply and return line connections 23 and 24. The coil and the inner and outer cylinders together form a second helical passageway 21, through which flows the domestic water to be heated. The arrows in the cutaway view indicate the direction of flow of boiler fluid (20) and domestic water (21). A water inlet tube 26 extends only a short distance into the second helical passageway 21. It thereby introduces the water into passageway 21 and induces it to flow through passageway 21. The location where tube 26 enters helical passageway 21 will typically include a solder joint, but this joint need not be perfectly watertight, since a small portion of inlet water escaping flow through passageway 21 will not appreciably affect the overall performance of the unit.

The water exiting the bottom of helical passageway 21 flows into the general tank volume, and up past the heat exchanger, both to the outside and through the central open region. This flow is indicated by the arrows. It then passes out of the tank via a hot water discharge line 25, which is connected to the hot water distribution plumbing.

When domestic water is passing through the unit, flow is in a counterflow direction in the heat exchanger, as shown by the arrows. The counterflow configuration is the most advantageous, since it results in the maximum heat exchanger effectiveness for a given surface area. In the counterflow arrangement, the boiler return fluid can be at a lower temperature than the hot water outlet temperature. Such a situation would be impossible if the heat exchanger were plumbed for parallel flow, and the amount of heat transferred would therefore be less.

In the recharge (free convection) mode, when there is no water flow through the unit, heat is transferred from the boiler fluid flowing in coil 20 to the quiescent water in the tank. In this mode, the fact that the heat exchanger is fully immersed in the tank is beneficial, since heat may be transferred from both the inner and outer cylinders. This configuration has more surface area for free convection heat transfer than one in which the boiler fluid tube is wrapped around the external sidewall of the tank, which is the configuration disclosed in the aforementioned water cooler patents. Again, note that the vertical orientation is best to maximize free convection heat transfer.

Locating temperature sensor 13 in the bottom center region of the tank means that a representative tank water temperature is measured in the recharge (free convection) heating mode, and that the temperature of the water exiting the heat exchanger is measured in the flow (forced convection) mode. Thus, in the flow mode, the controller can act to modulate the boiler heat input so as to maintain the temperature of the water exiting the heat exchanger at a temperature close to the setpoint. Since by far the major portion of heat is transferred inside the heat exchanger when the unit is in the flow mode, this location of the temperature sensor will closely track the hot water discharge temperature at 25, but at the same time, allow the controller to respond quickly to changes in load so as to minimize outlet temperature instability.

A layer of thermal insulation will be wrapped around the tank in order to minimize thermal loss. For the sake of clarity in the drawing, this has not been shown, but numerous standard materials including fiberglass or polyurethane foam can be used. In considering this issue, another advantage of the present invention is seen in comparison to a system in which the circulating fluid coil is wrapped around the outside of the tank. In the present invention, a tank wall temperature of about 140 F. is always maintained, whereas in the exterior coil wrap system, a tank wall temperature up to about 200 F. can occur during periods of heating. Maintaining the tank wall at a lower temperature results in a correspondingly lower heat loss.

What is claimed is:

1. In a heating system including a modulating boiler;

a closed loop for circulating fluid heated by the boiler, said loop including a boiler supply line, a boiler return line, and a pump for circulating said fluid;

automatic control means responsive to a temperature signal, whereby the heat input to the boiler and the circulation of the fluid in the loop may be controlled;

a cold water supply line;

a hot water discharge line;

the improvement being a semi-instantaneous water heater in the closed loop for heating water by transfer of heat from the circulating boiler fluid, comprising a tank for holding heated water;

a heat exchanger immersed in said tank, comprising a metal sheet rolled into an inner cylinder;

a metal sheet rolled into an outer cylinder of the same length as, and disposed relative to, the inner cylinder, so as to form an annular space therebetween;

a tube coiled in a helix, disposed in said annular space, with the spacing between the coils of the helix approximately equal to the tube diameter, and with the inner and outer cylinders in contact with the helical coil so as to form a second helical passageway, intertwined with the helical coil, in the annular space;

first connecting means passing through the wall of said tank, whereby one end of said helical coil is connected to the boiler supply line;

second connecting means passing through the wall of said tank, whereby the other end of said helical coil is connected to the boiler return line, and further whereby the closed boiler loop is completed for circulation of the fluid through the boiler and the helical coil;

third connecting means passing through the wall of said tank, whereby one end of said second helical passageway is connected to the cold water supply line such that water is introduced into the semi-instantaneous water heater and induced to flow through the second helical passageway before discharging from the other end of the second helical passageway into the general tank volume;

fourth connecting means in the tank wall for connection to the hot water discharge line, whereby heated water can be withdrawn from the tank;

means for sensing the temperature of the water in the tank, whereby said temperature signal is transmitted to the automatic control means.

2. The semi-instantaneous water heater of claim 1 wherein the tank has a substantially cylindrical shape, and further wherein the immersed helical heat exchanger is oriented substantially coaxial with the tank.

3. The semi-instantaneous water heater of claim 1 wherein the cold water supply line is connected to the second helical passageway so as to produce water flow in a counterflow direction to the flow of closed loop boiler fluid through the helical coil.

4. In a heating system including a modulating boiler;

a closed loop for circulating fluid heated by the boiler, said loop including a boiler supply line, a boiler return line, and a pump for circulating said fluid;

automatic control means responsive to a temperature signal, whereby the heat input to the boiler and the circulation of the fluid in the loop may be controlled;

a cold water supply line;

a hot water discharge line;

the improvement being a semi-instantaneous water heater in the closed loop for heating water by transfer of heat from the circulating boiler fluid, comprising a tank for holding heated water;

a heat exchanger immersed in said tank, comprising a metal sheet rolled into an inner cylinder;

a metal sheet rolled into an outer cylinder of the same length as, and disposed relative to, the inner cylinder, so as to form an annular space therebetween;

a tube coiled in a helix, disposed in said annular space, with the spacing between the coils of the helix approximately equal to the tube diameter, and with the inner and outer cylinders in contact with the helical coil so as to form a second helical passageway, intertwined with the helical coil, in the annular space;

a first tube which passes through the wall of said tank, one end of said first tube joined to one end of said helical coil, and the other end of said first tube connected to the boiler supply line;

a second tube which passes through the wall of said tank, one end of said second tube joined to the other end of said helical coil, and the other end of said second tube connected to the boiler return line, whereby the closed boiler loop is completed for circulation of the fluid through the boiler and the helical coil;

a third tube which passes through the wall of said tank, one end of said third tube connected to one end of said second helical passageway, the other end of said third tube connected to the cold water supply line, whereby water is introduced into the semi-instantaneous water heater and induced to flow through the second helical passageway before discharging from the other end of the second helical passageway into the general tank volume;

a fitting in the tank wall for connection to the hot water discharge line, whereby heated water can be withdrawn from the tank;

means for sensing the temperature of the water in the tank, whereby said temperature signal is transmitted to the automatic control means.

* * * * *